US006757920B2

(12) United States Patent
Antoniello et al.

(10) Patent No.: US 6,757,920 B2
(45) Date of Patent: Jul. 6, 2004

(54) HAND SPRAY MOUNTS WITH INTEGRAL BACKFLOW PREVENTION

(75) Inventors: Frank Antoniello, Commack, NY (US); Elmo John Wieman, Plainview, NY (US)

(73) Assignee: I.W. Industries. Inc., Melville, NY (US)

( * ) Notice: Subject to any disclaimer, the term of this patent is extended or adjusted under 35 U.S.C. 154(b) by 0 days.

(21) Appl. No.: 10/641,796

(22) Filed: Aug. 15, 2003

(65) Prior Publication Data

US 2004/0034920 A1 Feb. 26, 2004

Related U.S. Application Data

(63) Continuation of application No. 10/226,680, filed on Aug. 26, 2002, now Pat. No. 6,611,971.

(51) Int. Cl.[7] ..... A47K 3/20; A47K 4/00

(52) U.S. Cl. ..... 4/570; 137/218; 137/801

(58) Field of Search ..... 4/567, 570, 615; 137/218, 216, 216.2, 217, 315.33, 801

(56) References Cited

U.S. PATENT DOCUMENTS

| | | | | |
|---|---|---|---|---|
| 5,079,781 | A | 1/1992 | Gnauert et al. | 137/218 |
| 5,253,677 | A | 10/1993 | Sand | 137/216 |
| 5,701,926 | A | 12/1997 | Luisi | 137/218 |
| 5,970,534 | A | 10/1999 | Breda | 137/218 |
| 6,381,770 | B1 | 5/2002 | Raisch | 4/570 |

*Primary Examiner*—Tuan N. Nguyen
(74) *Attorney, Agent, or Firm*—Alfred M. Walker

(57) ABSTRACT

A wall mount provides the normal hose connection for attachment of the hose of a hand-held spray head while integrating a backflow preventer in an aesthetically pleasing unit. The wall mount preferably uses two spring-biased check valves with an integral air inlet and check valve to form redundant backflow prevention as well as an active vacuum breaker which substitutes ambient air for dirty water in the case of vacuum build-up. The wall mount includes a seal and locking technique which permits exact set-up of the orientation and wall fit of the unit with simple tools. An alternate embodiment of the wall mount also integrates the hook which holds the handle of the hand-held spray head.

9 Claims, 6 Drawing Sheets

HAND SPRAY MOUNTS WITH INTEGRAL BACKFLOW PREVENTION

RELATED APPLICATIONS:

This application is a continuation of application Ser. No. 10/226,680, filed Aug. 26, 2002 now U.S. Pat. No. 6,611,971.

FIELD OF THE INVENTION

The present invention relates to back flow preventers used to prevent contaminated water to flow through a hand spray mount.

BACKGROUND OF THE INVENTION

Both the International Association of Plumbing and Mechanical Officials (IAMPO) and American Society of Mechanical Engineers (ASME) have issued standards mandating the use of backflow prevention apparatus with hand held hose-connected shower heads. These include of hose connection vacuum breakers and check valve which must be screwed in separately between the wall-mount water supply and the hose connection of the hand spray.

These prevent the back flow of dirty water into the clean water supply in the event that the hose-connected shower head hand spray is submerged when a vacuum in the supply plumbing is formed, as by draining of the supply pipes or a water hammer caused by other distant plumbing devices. Since it is important to prevent such contamination, the current units have tamper resistant non-removable features (such as break-away set screws) once installed.

However, since this interferes with drainage that may be required during maintenance or repair, the apparatus is further complicated with an additional drainage feature where required. In high-end plumbing fixtures, these mandated add-on backflow preventers detract from an aesthetically pleasing installation.

OBJECTS OF THE INVENTION

It is therefore an object of the present invention to provide a hand spray mount with integral backflow prevention.

It is also an object of the present invention to provide an aesthetically pleasing hand spray mount which utilizes a vacuum breaking air gap to prevent the accidental backflow of contaminated bath water through a shower hand spray to a clean water supply.

Other objects which become apparent from the following description of the present invention.

SUMMARY OF THE INVENTION

The wall mounts of this invention provide the normal hose connection for attachment of the hose of a hand-held spray head while integrating a IAMPO/ASME mandated backflow preventer in an aesthetically pleasing unit.

These wall mounts use two spring-biased check valves with an integral air inlet and check valve to form redundant backflow prevention as an active vacuum breaker, which would substitute ambient air for dirty water in the case of vacuum build-up. Because they are integrated in the housing of the wall mount that provides the hose connection, there is no way to disconnect the backflow prevention apparatus.

Normal plumbing tools are used for simple attachment or removal. Another feature of the wall mounts of this invention is the o-ring seal and set screw locking technique which permits exact set-up of the orientation and wall fit of the unit with simple tools.

An alternate embodiment of these wall mounts also integrates the hook which holds the handle of the hand-held spray head.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
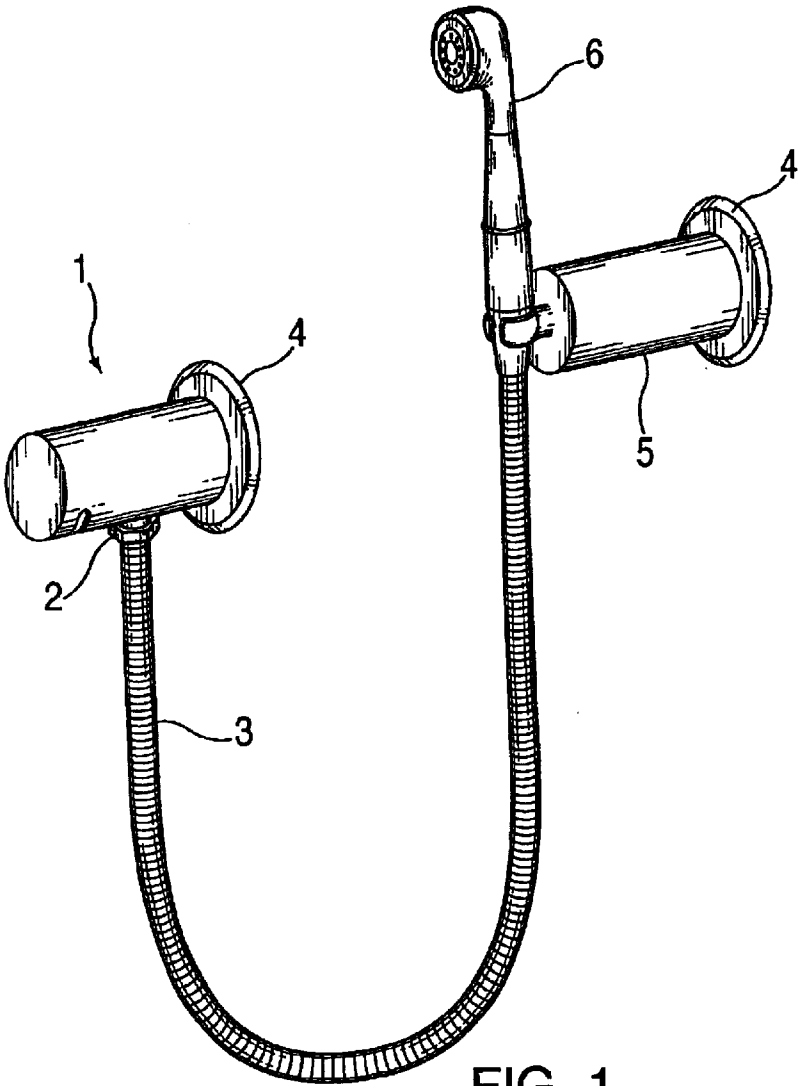
FIG. 1 is a perspective view of a hand-held spray installation using a wall mount of this invention.

FIG. 1 shows an installation using one embodiment for hand spray wall mount 1 with integral backflow prevention, escutcheon 4, hose connection 2, hose 3, hand-held spray head 6, and remote handle hook 5.

Figure 2:
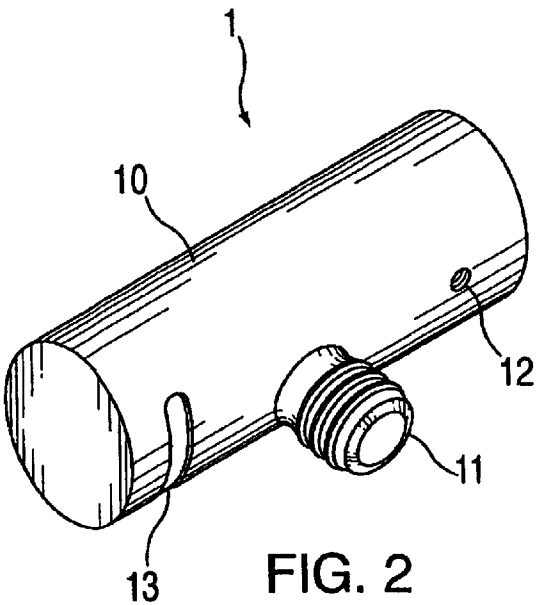
FIG. 2 is a perspective view of backflow prevention wall mount of this invention.

FIG. 2 is a close-up view of wall mount 1 with housing 10, set screw 12, vacuum breaking air intake slot 13 and hose nipple 11.

Figure 3:
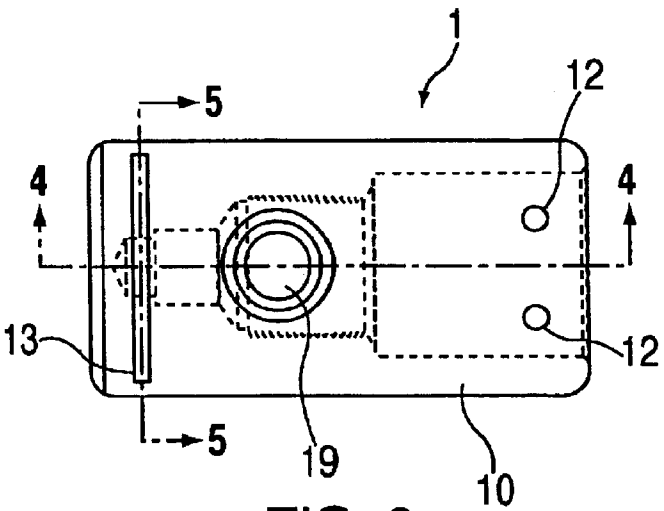
FIG. 3 is a bottom view of the wall mount of this invention.
Figure 5:
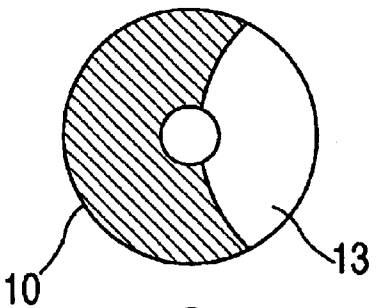
FIG. 5 is an end crossection view of the wall mount showing vacuum breaking air inlet taken along lines "5—5" of FIG. 3.

FIG. 3 is a bottom view of wall mount 1 with hose nipple 11 removed, showing outlet lumen 19. FIG. 5 is a crossection showing the internal shape of air intake slot 13 which fans out so as to be difficult to block inadvertently.

Figure 4:
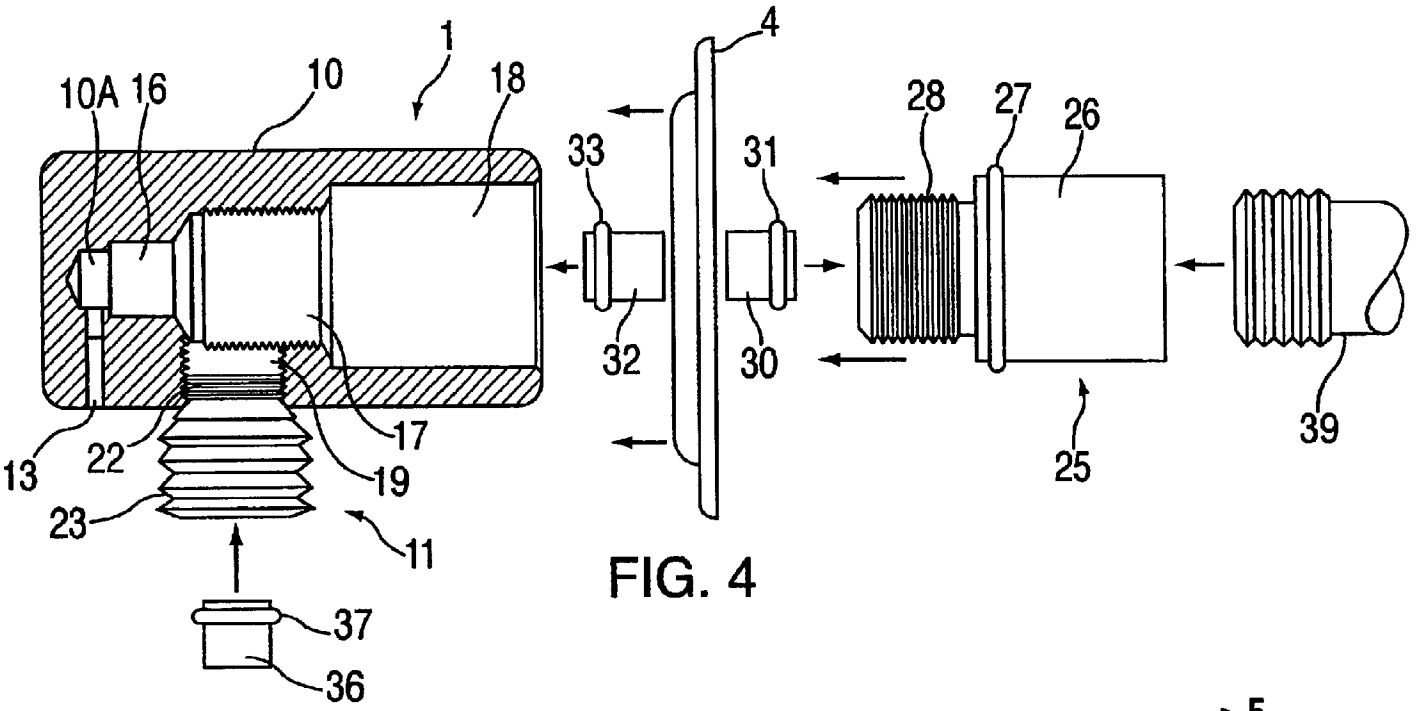
FIG. 4 is a side crossection view of the wall mount as in FIG. 1, with an exploded view of attached components taken along lines "4—4" of FIG. 3.

FIG. 4 is a side crossection of housing 10 of wall mount 1 along with an exploded view of the attached components shown in FIG. 1. Three spring-biased cartridge check valves are shown in FIG. 4. For example, check valve 32 with o-ring 33 is placed in distal cavity 16 to permit air intake through vacuum breaking slot 13 in case of a vacuum build-up and failure of check valve 30 and 36. Check valve 30 with o-ring 31 is placed in inlet nipple 25 to block any dirty water backflow. Check valve 36 with o-ring 37 is placed within hose nipple 11 to block backflow of dirty water from hose 3. Escutcheon 4 with an internal o-ring slides over an outer surface of housing 10 to present an aesthetic interface to the wall opening. Water inlet nipple 25 is threaded onto water supply pipe end 39. Housing 10 slips over smooth section 26 of water inlet nipple 25 and seals against large o-ring 27 via smooth bore 18. Housing 10 is then threaded such that external threads 28 of inlet nipple 25 engage internal threads 17 of housing 10 until the proper fit against the wall, with transversally extending threaded lumen 19 and hose nipple 11 pointing downward, is achieved. Check valve 36 fits within hose nipple 11. Outer threads 23 thereof engage hose connection 2 of flexible hose 3. Set screws in threaded holes 12 in housing 10 are then tightened against smooth section 26 of water inlet nipple 25 to complete the attachment of hand spray wall mount 1.

FIG. 5 shows arcuate vacuum breaking slot 13 communicating with bore 10*a* lending to inner, 4 axially aligned bores 16, 17 and 18 of housing, as well as indirectly to transverse bore 19 of housing 10.

Figure 6:
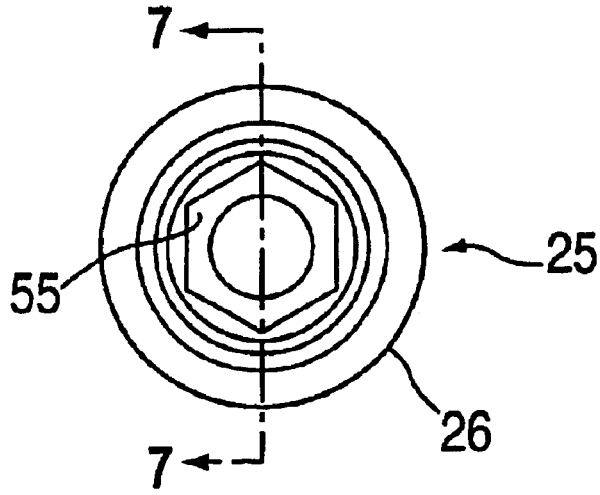
FIG. 6 is an end view of a water inlet nipple thereof.
Figure 7:
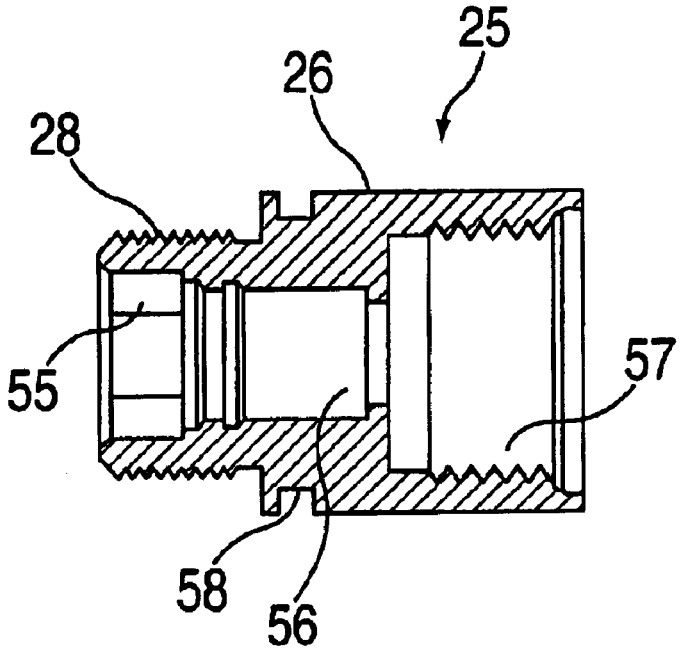
FIG. 7 is a side crossection view of the water inlet nipple.

FIGS. 6 and 7 show details of water inlet nipple 25. Hexagonal features 55 permit the use of a wrench to tighten water inlet nipple 25 onto pipe end 39 via internal threads 57 thereof.

Annular groove 58 receives large o-ring 27. Check valve 30 fits within cavity 56 of water inlet nipple 25.

Figure 8:
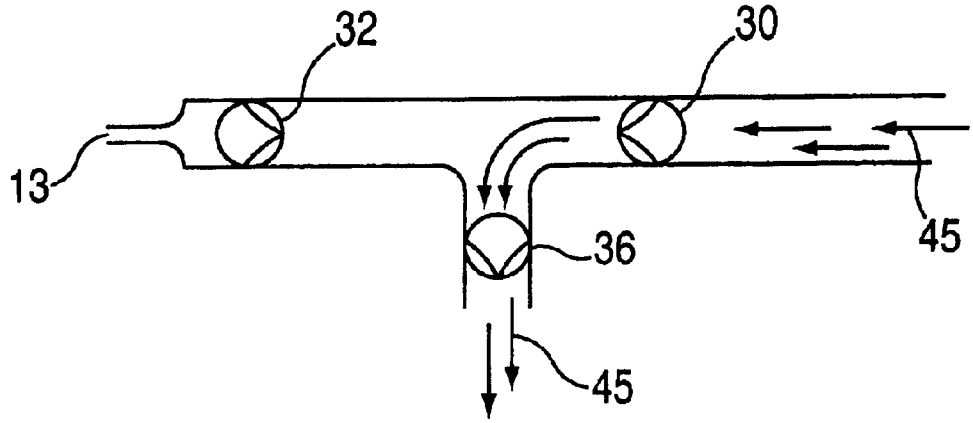
FIG. 8 is a water flow diagram of normal operation.

FIG. 8 is a diagram showing normal flow of clean water 45 through check valve 30 and then onward through check valve 36 in hose connection nipple 11. Water pressure seals check valve 32 closed so that no water leaks out of air intake 13.

Figure 9:
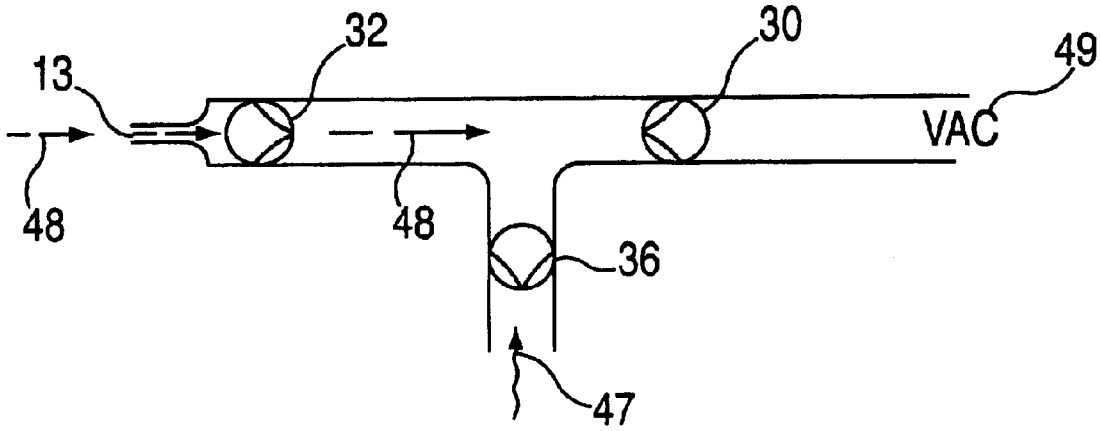
FIG. 9 is a diagram of a vacuum breaker air intake during a failure mode.

FIG. 9 shows the backflow prevention features of wall mount 1. The first line of defense is check valve 36 which should block any backflow of dirty water 47 from hose 3. If a vacuum is formed in supply pipe 39, check valve 30 should seal even harder, thereby preventing any backflow. If, however, both check valves 30 and 36 are defective or somehow overwhelmed by vacuum, check valve 32 will open providing an air gap between dirty water 47 and water inlet 49. Ambient air 48 from vacuum breaking air inlet slot 13 breaks the vacuum.

Figure 10:
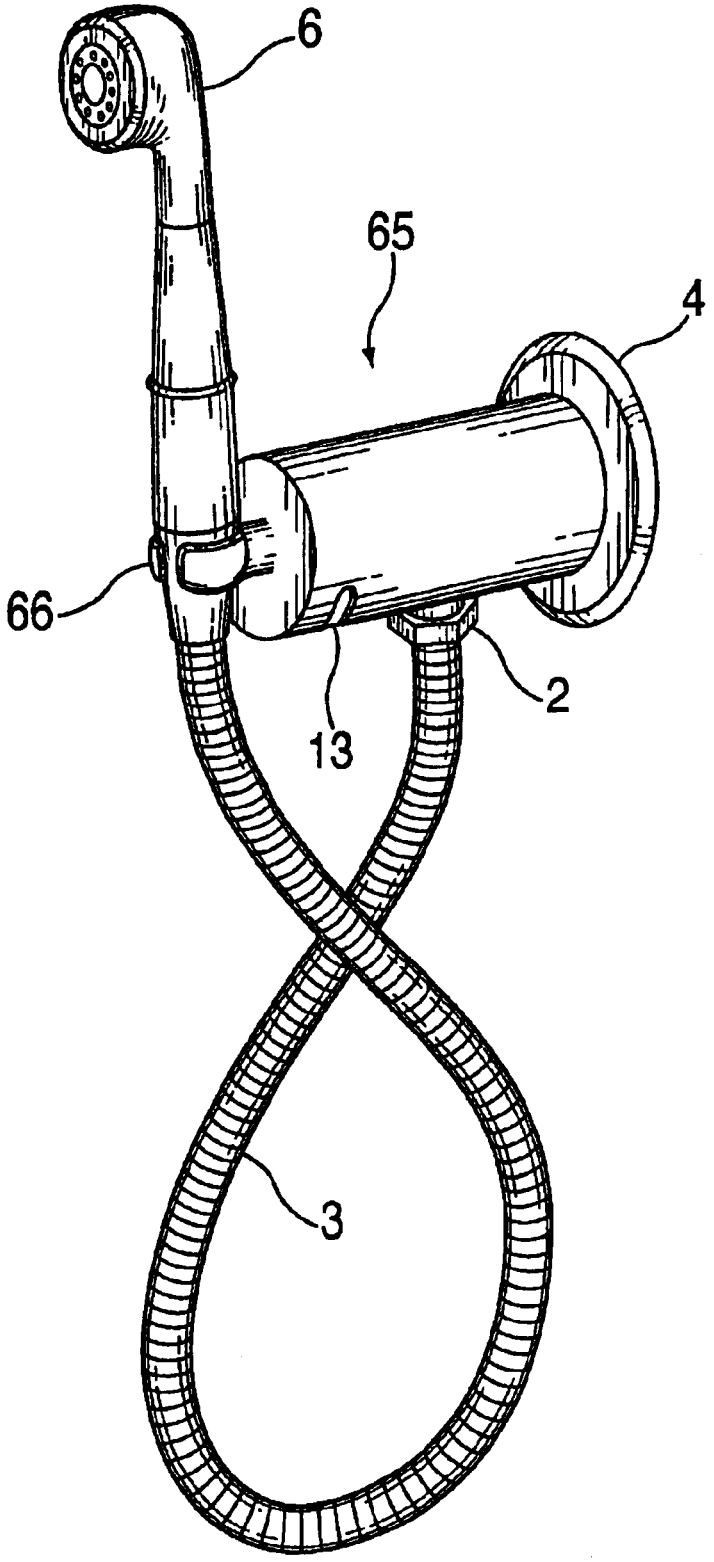
FIG. 10 is a perspective view of alternate embodiment of a backflow prevention wall mount installation with an integral handle hook.
Figure 11:
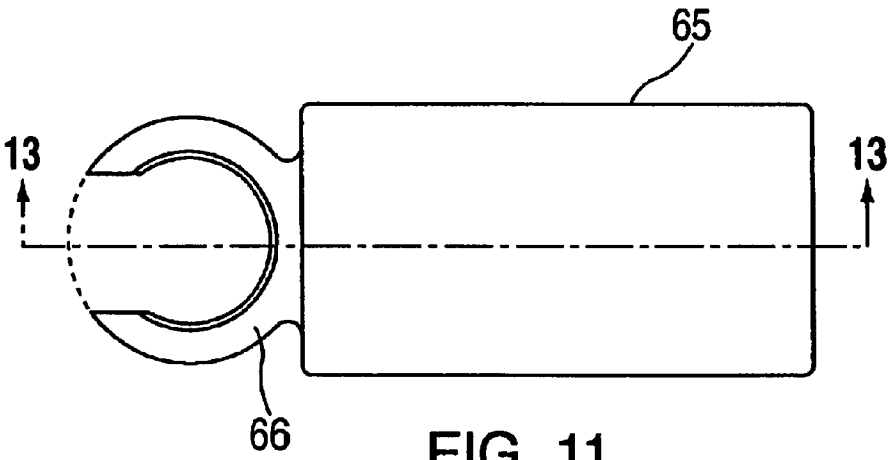
FIG. 11 is a top view of the wall mount as in FIG. 10 of this invention, with an integral handle hook.
Figure 12:
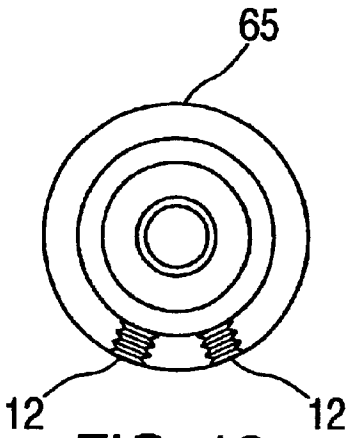
FIG. 12 is an end view of the wall mount, showing the position of the locking set screws; and, FIG. 13 is a side elevational view in crossection of the wall mount embodiment with an integral handle hook.

FIG. 10 shows an installation using an alternate embodiment of wall mount 65 with integral shower head handle hook 66 thereby eliminating the need for remote handle hook 5 as shown in FIG. 1. All other internal features, installation, and operation are identical to those concerning wall mount 1. For example, FIG. 11 shows a top view of wall mount 65. End view of FIG. 12 shows the orientation of set screw holes 12.

Figure 13:
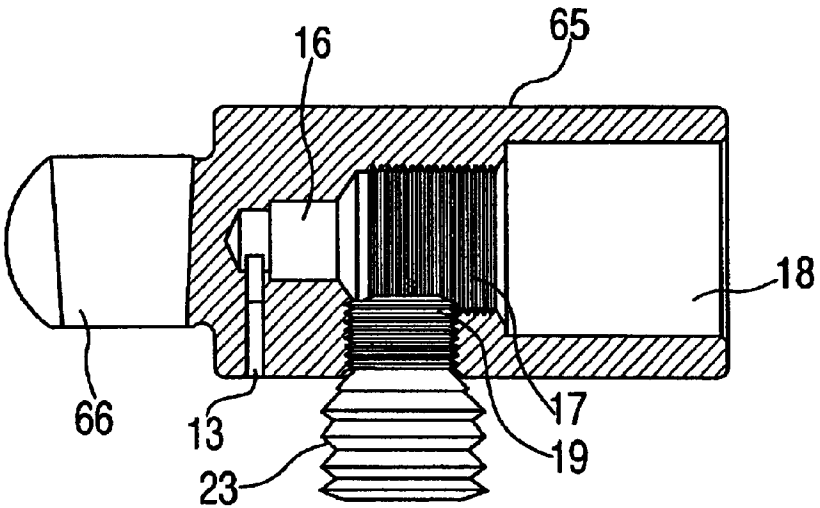

The side view in crossection of FIG. 13 shows the internal features of wall mount 65 with integral hook 66.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

What is claimed is:

1. A shower hand spray wall mount with integral backflow prevention comprising:

a housing in substantially external connection to a water supply and fastened to the visible surface of a wall of a shower, said housing attaching a flexible hose of a hand-held spray head to said wall, said housing having an axially extending bore therewithin, said housing integrating a IAMPO/ASME mandated backflow preventer, including at least one check valve communicating with an integral vacuum breaking air inlet substituting ambient air for dirty water into a water inlet of said axially extending bore, in the case of vacuum build-up within said bore of said housing, said at least one check valve permitting flow of air into said housing through said vacuum breaking air inlet when dirty water enters said axially extending bore of said housing upon said buildup of the vacuum within said axially extending bore of said housing.

2. The shower hand spray wall mount as in claim 1 wherein said vacuum breaking air inlet comprises an arcuate slot being provided in an exterior wall of said housing, said arcuate slot communicating with said at least one axially extending bore within said housing.

3. The shower band spray wall mount as in claim 2 wherein said vacuum breaking air intake slot fans outward from said at least one axially extending bore within said housing.

4. The shower hand spray wall mount as in claim 1 wherein said at least one check valve comprises a plurality of check valves.

5. The shower head spray wall mount as in claim 4 wherein one of said check valves is placed in a cavity, permitting air intake through said slot in case of a vacuum build-up.

6. The shower hand spray wall mount as in claim 4 wherein one of said check valves is placed in an inlet nipple.

7. The shower hand spray wall mount as in claim 4 wherein a check valve is placed within said hose nipple to block backflow of dirty water from said hose.

8. The shower hand spray wall mount as in claim 4 further comprising a lumen bore extending transversely to said at least one inner bore of said housing, said transversally extending bore receiving a hose nipple connected to said hose.

9. The shower hand spray wall mount as in claim 4 wherein said housing slips over a smooth section of said water inlet nipple, said housing being threaded such that external threads of said water inlet nipple engage internal threads of said housing until a proper fit against a wall with said threaded lumen bore pointing downward.

* * * * *